US006765163B2

(12) United States Patent
Aguado et al.

(10) Patent No.: US 6,765,163 B2
(45) Date of Patent: Jul. 20, 2004

(54) MECHANICAL RESET DEVICE FOR SWITCH

(75) Inventors: Jose-Miguel Aguado, Madrid (ES); Jose Sevilleja-Perez, Madrid (ES)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/311,762

(22) PCT Filed: Jun. 12, 2001

(86) PCT No.: PCT/US01/18897

§ 371 (c)(1),
(2), (4) Date: Jul. 11, 2003

(87) PCT Pub. No.: WO01/97238

PCT Pub. Date: Dec. 20, 2001

(65) Prior Publication Data

US 2004/0035689 A1 Feb. 26, 2004

(30) Foreign Application Priority Data

Jun. 12, 2000 (ES) ..... 200001471

(51) Int. Cl.[7] ..... H01H 3/36; H01H 17/00
(52) U.S. Cl. ..... 200/330
(58) Field of Search ..... 200/329–339; 187/276, 289, 306–311, 298, 299; 74/502–503

(56) References Cited

U.S. PATENT DOCUMENTS

| | | | | | |
|---|---|---|---|---|---|
| 3,267,248 | A | | 8/1966 | Bagley | 200/330 |
| 3,939,725 | A | * | 2/1976 | Fisher | 74/503 |
| 3,956,606 | A | * | 5/1976 | Reiter | 200/332.1 |
| 4,626,638 | A | * | 12/1986 | Samples et al. | 200/331 |

FOREIGN PATENT DOCUMENTS

| | | | | |
|---|---|---|---|---|
| DE | 29 35 420 B1 | | 3/1980 | |
| EP | 0 923 095 A1 | | 6/1999 | |
| WO | WO 02/97238 A1 | * | 12/2002 | H01H/3/16 |

* cited by examiner

*Primary Examiner*—James R. Scott

(57) ABSTRACT

The invention is applicable to automatically triggered switches that are turned on by means of angular displacement, in either direction, of a contact bridge and its support (1). It is characterized in that the outside of the support (1) includes pins (3) which, when the switch is off, are perpendicular to the direction of displacement of an actuator (4) joined to a remote handle (13). Since the pins (3) turn as a consequence of the switch being turned on, when the handle is operated, the actuator (4) is displaced and its arms (6) force the pins (3) to move in the opposite direction into their initial position, effecting the reset. It is preferably used to reset switches provided in elevator speed limiters.

9 Claims, 3 Drawing Sheets

MECHANICAL RESET DEVICE FOR SWITCH

FIELD OF THE INVENTION

The invention refers to a mechanical reset device for a switch, and it allows said reset to be realized from a location at a distance from the switch.

Therefore the invention has been especially designed to reset switches located in inaccessible or hard-to-reach places.

The invention is applicable to automatically triggered switches that are turned on by means of the angular displacement, in either direction, of a contact bridge and its support.

An example of this type of switch is the switch provided in speed limiters for elevators, which is found in an inaccessible place.

BACKGROUND OF THE INVENTION

Conventionally, it is known that elevators use speed limiters incorporating switches that turn on automatically when the elevator exceeds a certain speed. These switches are turned on through the angular displacement of the contact bridge, in one of two directions, depending on whether the elevator is going up or down, and to reset the switch, it must be accessed and manually turned in the direction opposite the contact bridge.

Speed limiters for elevators are set in places that are hard to access, so resetting is complicated.

To resolve this disadvantage, the use of electromechanical devices that allow resetting at a distance is known. These devices have the disadvantage that, if there is a break in the electrical current, the reset cannot be carried out.

DESCRIPTION OF THE INVENTION

To resolve the disadvantages mentioned above, the invention presents a totally mechanical device that makes it possible to reset a switch from a location at a distance from said switch. The device is totally mechanical, so that interruptions in electrical power do not prevent the reset from being effected.

As mentioned earlier, the invention is applicable to automatically triggered switches that are turned on by means of angular displacement, in either direction, of the contact bridge and its support.

The invention is characterized in that the outside of the contact bridge support comprises at least one extension that, when the contact bridge is closed, is perpendicular to the direction of displacement of an actuator and is separated from the actuator by a certain distance.

The actuator is connected to a remote handle so that it can be moved by operating said handle.

Thus, when the contact bridge is opened by means of the angular displacement of the same bridge and its support, the angular displacement of the extension is also produced, so that, when the handle is operated, the actuator shifts, contacting and pressing against the extension and forcing it to return to its initial position, which produces the reset of the contact bridge.

In one preferable embodiment of the invention, the at least one extension consists of two pin-shaped extensions. The central branch of a T-shaped piece forming the actuator runs between these pin-shaped extensions. In this case, when the contact bridge is opened, the pins shift angularly, so that, depending on the direction of rotation, one of the pins approaches the arms of the T-shaped piece and the other pin moves away from the arms. In this case, the reset is realized by operating the handle, which displaces the T-shaped piece, and one of the arms of this piece presses against the closest pin, forcing the contact bridge to return to its initial position, where the other arm of the T-shaped piece contacts the corresponding pin, producing the reset.

In another embodiment of the invention, the at least one extension consists of a small partition which, in the idle position, is located parallel to a small wall that comprises the actuator. In this case the opening of the contact bridge produces the angular displacement of the partition, so that one of its ends approaches the small wall and the other moves away from the wall, in such a way that, when the handle is operated, the wall approaches the closer end of the partition, pressing against it and forcing it to shift in the opposite direction toward the initial reset position, in which the partition and the wall are parallel and in contact.

In either of the described embodiments, the actuator is assisted by a spring, so that after the reset is effected and the handle is no longer acted upon, the actuator is forced to return to its initial idle position.

The actuator is joined to the handle by a cable housed in a sleeve. The ends of the sleeve are attached to a support of the handle and to a support of the actuator.

The end of the actuator has an elastic stop that limits the movement of the actuator during reset, so that it stops at the end of the sleeve through which the cable runs.

Furthermore, the actuator has a stop that stops at the frame of the switch to define the initial idle position of the actuator.

Finally, it is worth pointing out that the handle also has an elastic stop that limits its movement when it is released after the reset is effected. To facilitate better understanding of this description and forming an integral part thereof, a series of figures is attached below in which the object of the invention has been represented with illustrative, non-restrictive features.

DESCRIPTION OF THE PREFERRED EMBODIMENT

A description of the invention based on the figures mentioned above is presented in the following.

The device of the invention is applied to a switch that comprises a support 1 carrying a contact bridge, the entire set being carried on frame 2. The switch is not represented in detail, since it is conventional and is not the object of the invention; however, it must be pointed out that the contact bridge opens automatically by means of the angular displacement of support 1 and of the contact bridge.

Figure 1:
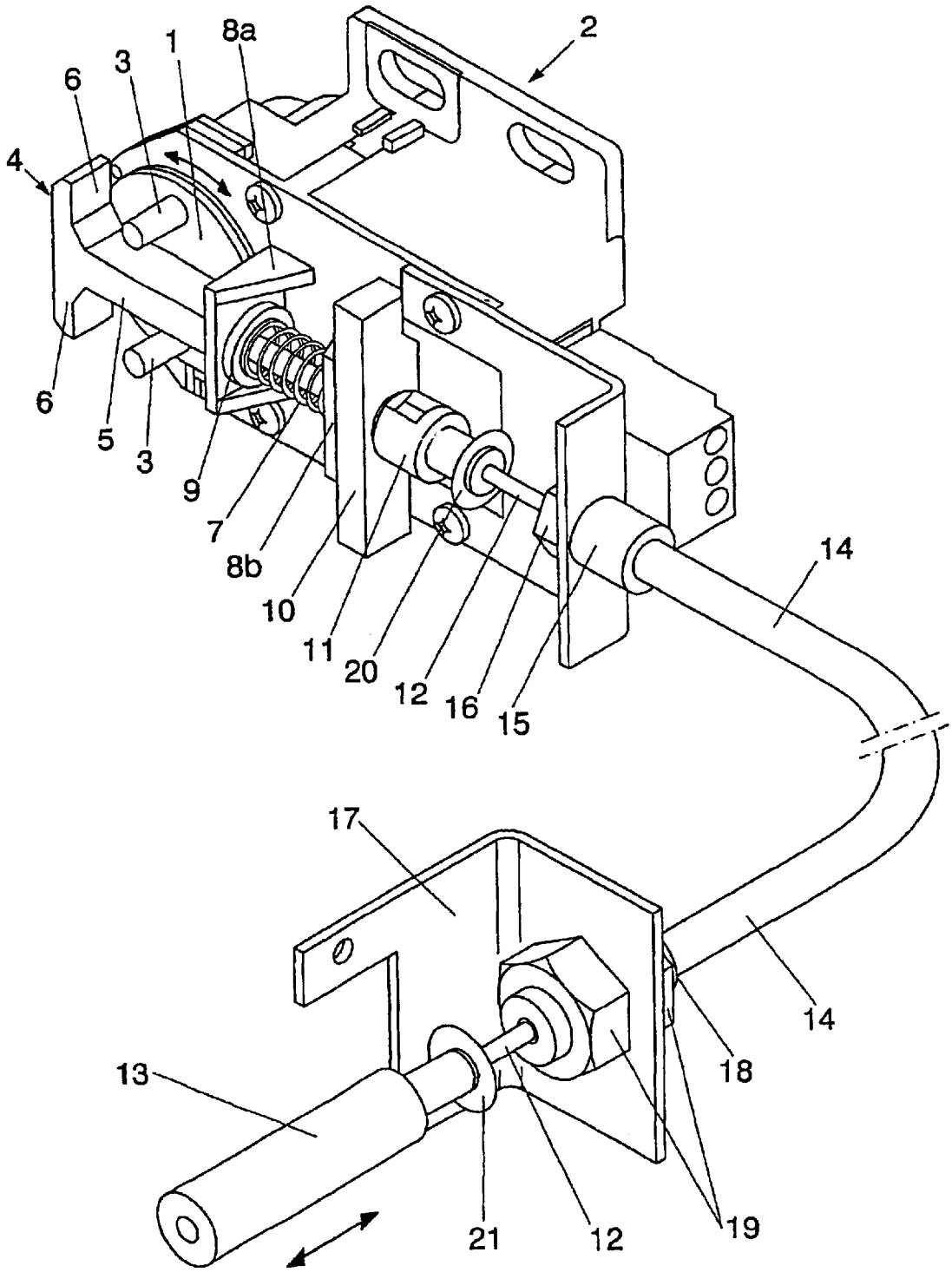
FIG. 1 shows a perspective view of one possible embodiment of the device of the invention.
Figure 2:
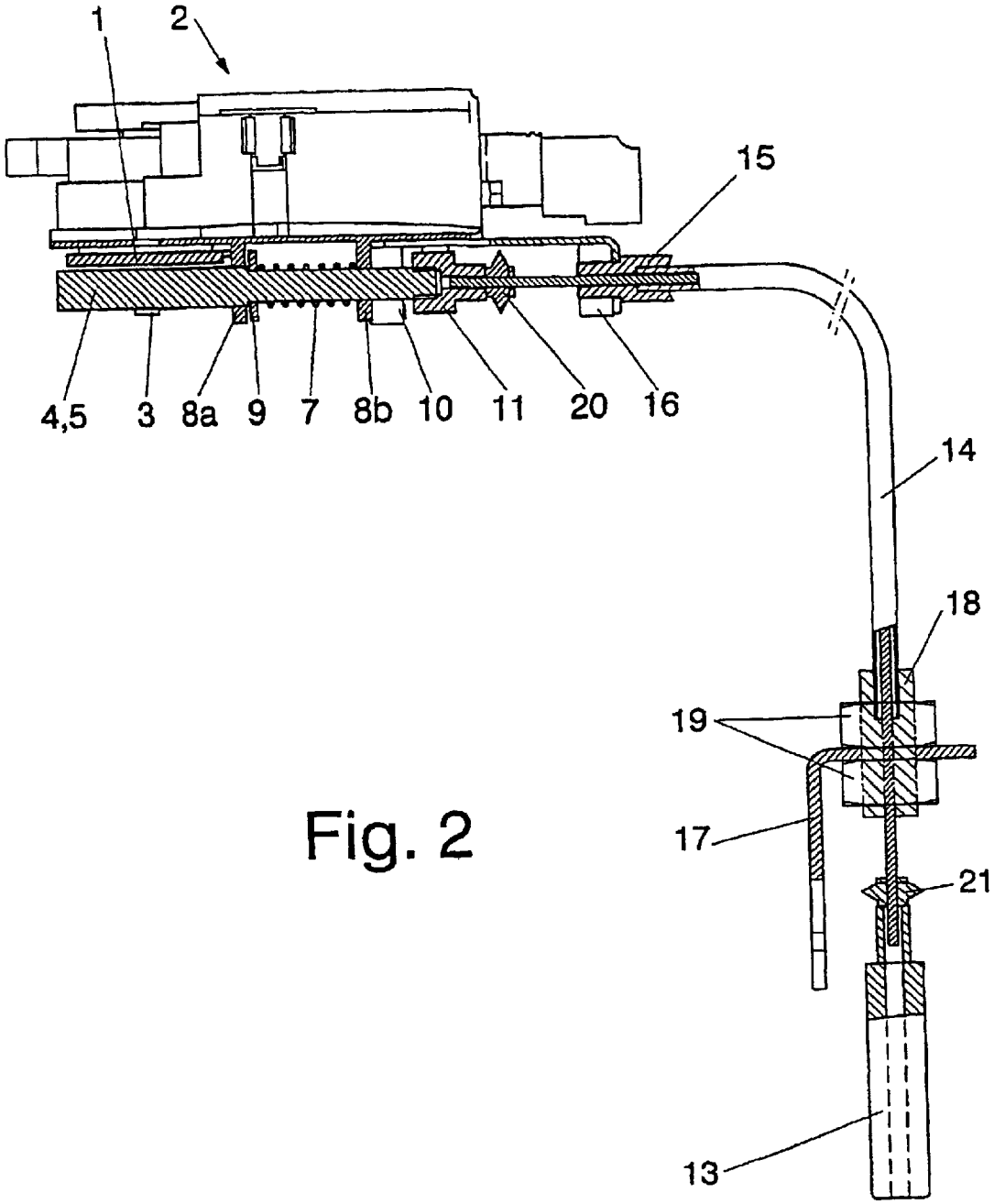
FIG. 2 shows a partially sectioned plan view of the device represented in the previous figure.

The novelty of the embodiment of the invention illustrated in FIGS. 1 and 2 lies in the fact that support 1 has two pin-shaped extensions 3 and the central branch 5 of a T-shaped actuator 4 is positioned between these pin-shaped extensions. In the position at which the contact bridge is closed, pins 3 are located parallel to arms 6 of actuator 4.

Actuator 4 can be displaced so that it is guided into frame 2 by means of tabs 8*a* and 8*b*.

In addition, actuator 4 is assisted by a spring 7, whose front end is supported by washer 9 and whose back end stops at tab 8*b* of frame 2.

Moreover, actuator 4 is solidly joined to stop 10, and its back end is capped by terminal 11 which forms the connection to cable 12, whose opposite end is connected to handle 13.

Cable 12 runs through sleeve 14, which allows the cable to move when handle 13 is operated.

Sleeve 14 is mounted to frame 2 by means of terminal 15 which houses the end of sleeve 14 and is held by nut 16.

The other end of sleeve 14 is attached to support 17 of handle 13 by means of terminal 18 and by two nuts 19 that enable regulation of the tension of the covering.

Terminal 11 is protected by elastic stop 20 and handle 13 is protected by elastic stop 21.

On the basis of the description that has been made, it is easy to understand that when the contact bridge is opened, pins 3 are displaced angularly in one of two rotating directions, which in the case of an elevator depends on whether the switch is activated when the elevator is going up or going down, so that one of pins 3 approaches one of arms 6 and the other pin moves away from the arms. In this situation, if one operates handle 13, the force of spring 7 is exceeded so that the spring is compressed against tab 8*b*, and actuator 4 is displaced in such a manner that it reaches a point at which one of arms 6 contacts pin 3, forcing it to move in the direction opposite the motion produced by turning the switch on, until the other pin 3 contacts the corresponding arm 6, in which position the reset of the switch is produced. In this maneuver, elastic stop 20 limits the final movement of the actuator that corresponds to the point at which both arms 6 contact pins 3.

Once the reset is effected, if handle 13 is released, spring 7 forces both actuator 4 and handle 13 to return to their initial positions as stop 10 contacts tab 8*a*, so that the device is ready to execute a new reset.

Figure 3:
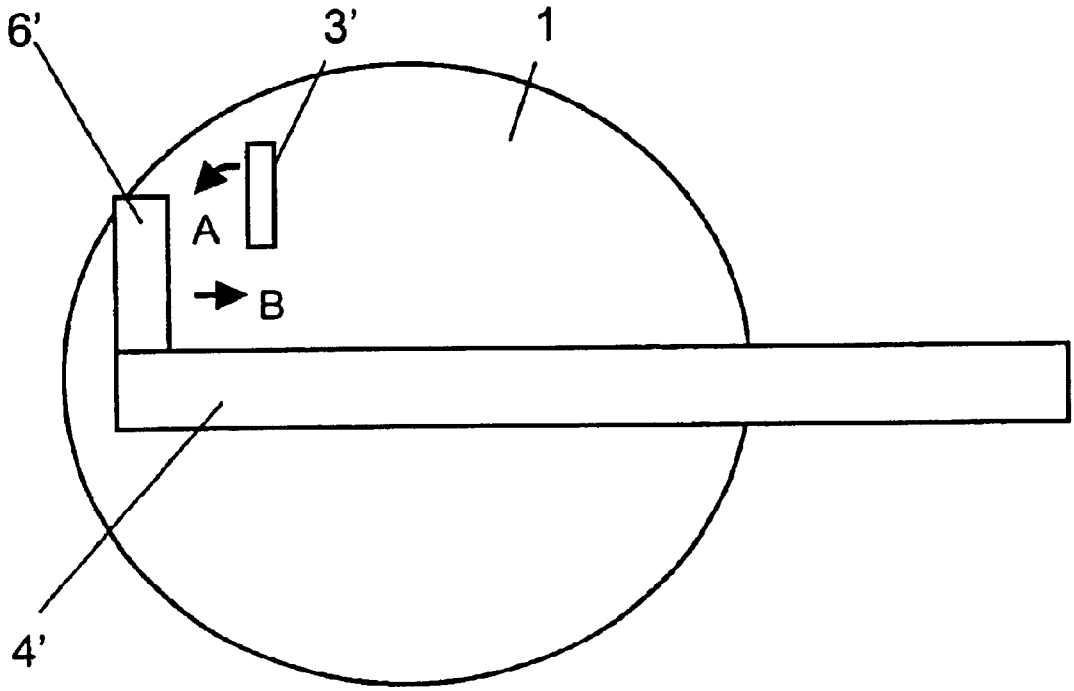
FIG. 3 schematically shows a plan view of another possible embodiment of the device of the invention.

Another embodiment of the invention is shown schematically in FIG. 3. The at least one extension consists of a small partition 3' that, in its idle position, is parallel to a small wall 6' formed by the actuator 4'. In this case the opening of the contact bridge produces the angular displacement of the partition, as indicated by the arrow A. Reset is produced when the actuator 4' moves in the direction indicated by the arrow B and presses its wall against the partition 3', forcing the partition 3' to shift angularly until it is located parallel to and in contact with the wall of the actuator.

What is claimed is:

1. A mechanical reset device for switch, for application to automatically triggered switches that are turned on by means of angular displacement, in either direction, of a contact bridge and its support, comprising:

a remote handle;

an actuator connected to the remote handle; and at least one extension provided on the outside of the support of the contact bridge, wherein when the contact bridge is closed, the at least one extension is substantially perpendicular to the direction of displacement of the actuator and is separated from the actuator by a certain distance, the actuator being connected to the remote handle so that, since the extension turns as a consequence of the opening of the contact bridge, operation of the handle displaces the actuator, which contacts and presses against the extension and forces the extension to shift, resulting in the reset of the contact bridge.

2. The mechanical reset device for switch according to claim 1, wherein the at least one extension comprises two pin-shaped extensions, the central branch of a T-shaped piece forming the actuator runs between these pin-shaped extensions, so that the reset may be produced by displacing the actuator by virtue of one of the arms of the T-shaped piece pressing against the pin which, in the opening of the contact bridge, approached the corresponding arm.

3. The mechanical reset device for switch according to claim 1, wherein the at least one extension comprises a small partition that, when in an idle position, is parallel to a small wall formed by the actuator, so that the reset is produced when the actuator moves and presses the wall against the partition, forcing the partition to shift angularly until it is located parallel to and in contact with the wall of the actuator.

4. The mechanical reset device for switch according to claim 2 or 3, wherein the actuator is assisted by a spring that keeps the actuator in an idle position in which the actuator is separated from the at least one extension, so that after the handle is moved and the force of the spring is exceeded, when the handle is released the actuator will return to the initial idle position.

5. The mechanical reset device for switch according to claim 1, wherein the actuator is connected to the handle by a cable housed in a sleeve, whose ends are attached to a support of the handle and to the frame of the actuator.

6. The mechanical reset device for switch according to claim 1, wherein the actuator includes an elastic stop that limits the movement of the actuator during the reset operation.

7. The mechanical reset device for switch according to claim 4, wherein the actuator incorporates a stop that stops at the frame of the switch to limit the extension of the spring and to maintain the initial idle position of the actuator.

8. The mechanical reset device for a switch according to claim 1, wherein the handle has an elastic stop.

9. The mechanical reset device for a switch according to claim

* * * * *